US011219563B2

(12) United States Patent
Li

(10) Patent No.: US 11,219,563 B2
(45) Date of Patent: Jan. 11, 2022

(54) ADJUSTABLE BACKREST AND WHEELCHAIR THEREWITH

(71) Applicant: Wonderland Switzerland AG, Steinhausen (CH)

(72) Inventor: Jian-Qun Li, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 61 days.

(21) Appl. No.: 16/861,231

(22) Filed: Apr. 29, 2020

(65) Prior Publication Data

US 2020/0352804 A1 Nov. 12, 2020

(51) Int. Cl.
*A47C 1/024* (2006.01)
*A61G 5/10* (2006.01)
*A61G 5/12* (2006.01)

(52) U.S. Cl.
CPC ..... *A61G 5/1067* (2013.01); *A61G 5/121* (2016.11)

(58) Field of Classification Search
CPC ..... A61G 5/1067; A61G 5/121
USPC ..... 297/354.12
See application file for complete search history.

(56) References Cited

U.S. PATENT DOCUMENTS 6,478,327 B1 * 11/2002 Hartenstine ..... B62B 7/06 280/47.38
6,666,473 B2 * 12/2003 Hartenstine ..... A47D 13/06 280/642
6,830,254 B2 * 12/2004 Lan ..... B62B 7/083 297/354.12 X
7,044,497 B2 * 5/2006 Hartenstine ..... B62B 7/06 280/642
2008/0217966 A1 * 9/2008 Cone ..... B62B 7/068 297/47
2009/0200838 A1 * 8/2009 Cone, II ..... B62B 7/08 297/16.2
2010/0013281 A1 * 1/2010 Chen ..... B62B 9/12 297/243

(Continued)

FOREIGN PATENT DOCUMENTS

CN 205493201 U 8/2016
CN 107296414 A 10/2017

(Continued)

*Primary Examiner* — Rodney B White
(74) *Attorney, Agent, or Firm* — Winston Hsu

(57) ABSTRACT

An adjustable backrest is adapted for a chair frame and includes a first pivoting component, a second pivoting component, a backrest sliding assembly and a backrest connecting component. The second pivoting component is pivoted to the first pivoting component. The backrest sliding assembly is slidably disposed on the first pivoting component. The backrest connecting component is disposed between the first pivoting component and the second pivoting component. A first end of the backrest connecting component is pivoted to the backrest sliding assembly. A second end of the backrest connecting component is pivoted to the second pivoting component. The backrest sliding assembly drives the second pivoting component to pivot relative to the first pivoting component by the backrest connecting component when the at least one backrest sliding assembly slides relative to the first pivoting component, so as to support a user's back portion at different angles.

20 Claims, 14 Drawing Sheets

(56) References Cited

U.S. PATENT DOCUMENTS

| | | | | |
|---|---|---|---|---|
| 2010/0244408 | A1* | 9/2010 | Dean | B62B 7/08 280/647 |
| 2011/0156454 | A1* | 6/2011 | Yi | B62B 9/104 297/183.1 |
| 2011/0175306 | A1* | 7/2011 | Newhard | B62B 9/104 297/354.13 X |
| 2011/0175406 | A1* | 7/2011 | Zeng | B62B 9/104 297/183.1 |
| 2012/0074747 | A1* | 3/2012 | Chen | B62B 9/104 297/256.13 |
| 2013/0277949 | A1* | 10/2013 | Yin | B60N 2/1685 280/658 |
| 2014/0008946 | A1* | 1/2014 | Smith | B62B 9/104 297/183.1 |
| 2014/0054938 | A1* | 2/2014 | Shan | A47D 1/10 297/217.1 |
| 2014/0062146 | A1* | 3/2014 | Haut | B62B 7/00 297/183.1 |
| 2014/0319884 | A1* | 10/2014 | Doucette | B62B 7/00 297/118 |
| 2016/0039448 | A1* | 2/2016 | Wang | B62B 9/142 297/92 |
| 2021/0196540 | A1* | 7/2021 | Zhang | A47C 7/5066 |

FOREIGN PATENT DOCUMENTS

| | | | |
|---|---|---|---|
| DE | 690 23 251 | T2 | 4/1996 |
| DE | 20 2008 017 981 | U1 | 2/2011 |
| DE | 10 2011 116 098 | B4 | 11/2013 |
| DE | 20 2018 003 805 | U1 | 9/2018 |
| DE | 10 2020 107 764 | A1 | 9/2020 |
| EP | 2 233 044 | A1 | 9/2010 |
| EP | 2 946 758 | A1 | 11/2015 |

* cited by examiner

ADJUSTABLE BACKREST AND WHEELCHAIR THEREWITH

BACKGROUND OF THE INVENTION

1. Field of the Invention

The present invention relates to a wheelchair, and more particularly, to an adjustable backrest adapted for a chair frame and a wheelchair therewith.

2. Description of the Prior Art

A wheelchair is specifically designed for providing a safe mobility to a disabled or elder person. The conventional wheelchair includes a fixed leg rest and a fixed backrest, i.e., an angle of the leg rest and an angle of the backrest cannot be adjusted. For a person who has difficulty in moving and lives alone, sitting on the wheelchair with same gesture for a long time causes pain and tingling in his/her back and/or legs, especially calves.

Therefore, there is a need to provide an adjustable backrest adapted for a chair frame and a wheelchair therewith.

SUMMARY OF THE INVENTION

It is an objective of the present invention to provide an adjustable backrest adapted for a chair frame and a wheelchair therewith for solving the aforementioned problem.

In order to achieve the aforementioned objective, the present invention discloses an adjustable backrest adapted for a chair frame whereon a user sits. The adjustable backrest includes a first pivoting component, a second pivoting component, at least one backrest sliding assembly and at least one backrest connecting component. The second pivoting component is pivoted to the first pivoting component. The at least one backrest sliding assembly is slidably disposed on the first pivoting component. The at least one backrest connecting component is disposed between the first pivoting component and the second pivoting component. A first end of the at least one backrest connecting component is pivoted to the at least one backrest sliding assembly. A second end of the at least one backrest connecting component is pivoted to the second pivoting component, and the at least one backrest sliding assembly drives the second pivoting component to pivot relative to the first pivoting component by the at least one backrest connecting component when the at least one backrest sliding assembly slides relative to the first pivoting component. One of the first pivoting component and the second pivoting component is pivoted to the chair frame, and another of the first pivoting component and the second pivoting component supports the user's back portion.

Preferably, in an embodiment of the present invention, the at least one backrest sliding assembly includes a backrest shell and a backrest releasing operating component. The backrest shell is slidably disposed on the first pivoting component. The backrest releasing operating component is pivoted to the backrest shell. A plurality of backrest engaging holes is formed on the first pivoting component. The backrest releasing operating component pivotally engages with a corresponding one of the plurality of backrest engaging holes for preventing sliding movement of the at least one backrest sliding assembly relative to the first pivoting component. The backrest releasing operating component pivotally disengages from the corresponding one of the plurality of backrest engaging holes for allowing the sliding movement of the at least one backrest sliding assembly relative to the first pivoting component.

Preferably, in an embodiment of the present invention, the backrest shell is slidably sleeved on the first pivoting component. A backrest accommodating chamber is formed in the backrest shell. A backrest opening is formed on the backrest shell and communicated with the backrest accommodating chamber, and the backrest releasing operating component is at least partially disposed inside the backrest accommodating chamber.

Preferably, in an embodiment of the present invention, the at least one backrest sliding assembly further includes a backrest resilient component. A middle portion of the backrest releasing operating component is pivoted to the backrest shell, and the at least one backrest resilient component is disposed inside the backrest accommodating chamber and located between the first pivoting component and an abutting end of the backrest releasing operating component to bias an engaging end of the backrest releasing operating component to engage with the corresponding one of the plurality of backrest engaging holes.

Preferably, in an embodiment of the present invention, the backrest releasing operating component includes a backrest operating portion and a backrest engaging portion fixed with the backrest operating portion. The backrest engaging portion is pivoted to the backrest shell, and the backrest engaging portion is driven to pivotally engage with or disengage from the corresponding one of the plurality of backrest engaging holes by operation of the backrest operating portion.

Preferably, in an embodiment of the present invention, a protrusion protrudes from the backrest engaging portion for engaging with the corresponding one of the plurality of backrest engaging holes.

Preferably, in an embodiment of the present invention, the adjustable backrest further includes an operating rod fixedly connected to the backrest releasing operating component for driving the backrest releasing operating component to pivot relative to the backrest shell.

Preferably, in an embodiment of the present invention, the adjustable backrest further includes an auxiliary rod disposed on the first pivoting component and for cooperating with the operating rod for driving the backrest releasing operating component to pivot relative to the backrest shell.

In order to achieve the aforementioned objective, the present invention further discloses a wheelchair. The wheelchair includes a chair frame whereon a user sits and an adjustable backrest. The adjustable backrest includes a first pivoting component, a second pivoting component, at least one backrest sliding assembly and at least one backrest connecting component. The second pivoting component is pivoted to the first pivoting component. The at least one backrest sliding assembly is slidably disposed on the first pivoting component. The at least one backrest connecting component is disposed between the first pivoting component and the second pivoting component. A first end of the at least one backrest connecting component is pivoted to the at least one backrest sliding assembly. A second end of the at least one backrest connecting component is pivoted to the second pivoting component, and the at least one backrest sliding assembly drives the second pivoting component to pivot relative to the first pivoting component by the at least one backrest connecting component when the at least one backrest sliding assembly slides relative to the first pivoting component. One of the first pivoting component and the second pivoting component is pivoted to the chair frame, and another of the first pivoting component and the second pivoting component supports the user's back portion.

Preferably, in an embodiment of the present invention, the wheelchair further includes an adjustable headrest, and the adjustable headrest includes a headrest supporting component and at least one headrest sliding assembly. The at least one headrest sliding assembly is slidably disposed on the adjustable backrest. The headrest supporting component is installed on the at least one headrest sliding assembly. A height of the headrest supporting component is adjustable by sliding movement of the at least one headrest sliding assembly relative to the adjustable backrest.

Preferably, in an embodiment of the present invention, the at least one headrest sliding assembly includes a headrest shell and a headrest releasing operating component. The headrest shell is slidably disposed on the adjustable backrest. The headrest releasing operating component is pivoted to the headrest shell. A plurality of headrest engaging holes is formed on the adjustable backrest. The headrest releasing operating component pivotally engages with a corresponding one of the plurality of headrest engaging holes for preventing the sliding movement of the at least one headrest sliding assembly relative to the adjustable backrest. The headrest releasing operating component pivotally disengages from the corresponding one of the plurality of headrest engaging holes for allowing the sliding movement of the at least one headrest sliding assembly relative to the adjustable backrest.

Preferably, in an embodiment of the present invention, the headrest shell is slidably sleeved on the adjustable backrest. A headrest accommodating chamber is formed in the headrest shell. A headrest opening is formed on the headrest shell and communicated with the headrest accommodating chamber, and the headrest releasing operating component is at least partially disposed inside the headrest accommodating chamber.

Preferably, in an embodiment of the present invention, the at least one headrest sliding assembly further includes a headrest resilient component. A middle portion of the headrest releasing operating component is pivoted to the headrest shell, and the headrest resilient component is disposed inside the headrest accommodating chamber and located between the adjustable backrest and an abutting end of the headrest releasing operating component to bias an engaging end of the headrest releasing operating component to engage with the corresponding one of the plurality of headrest engaging holes.

Preferably, in an embodiment of the present invention, the headrest releasing operating component includes a headrest operating portion and a headrest engaging portion fixed with the headrest operating portion. The headrest engaging portion is pivoted to the headrest shell, and the headrest engaging portion is driven to pivotally engage with or disengage from the corresponding one of the plurality of headrest engaging holes by operation of the headrest operating portion.

Preferably, in an embodiment of the present invention, the wheelchair further includes a canopy disposed on one of the headrest supporting component and the at least one headrest sliding assembly.

Preferably, in an embodiment of the present invention, the chair frame includes a front frame component and a rear frame component pivoted to the front frame component, and the one of the first pivoting component and the second pivoting component is pivoted to the rear frame component.

Preferably, in an embodiment of the present invention, the chair frame further includes at least one handrail disposed between the rear frame component and the one of the first pivoting component and the second pivoting component. A first end of the at least one handrail is pivoted to the rear frame component. A second end of the at least one handrail is pivoted to the one of the first pivoting component and the second pivoting component, and the one of the first pivoting component and the second pivoting component drives the rear frame component to pivot relative to the front frame component by the at least one handrail when the one of the first pivoting component and the second pivoting component pivots relative to the rear frame component.

Preferably, in an embodiment of the present invention, the chair frame further includes at least one handrail connecting component disposed between the rear frame component and the one of the first pivoting component and the second pivoting component. A first end of the at least one handrail connecting component is pivoted to the rear frame component. A second end of the at least one handrail connecting component is pivoted to the one of the first pivoting component and the second pivoting component, and the one of the first pivoting component and the second pivoting component drives the rear frame component to pivot relative to the front frame component by the at least one handrail connecting component when the one of the first pivoting component and the second pivoting component pivots relative to the rear frame component.

Preferably, in an embodiment of the present invention, the chair frame further includes a frame restraining component pivoted to the one of the first pivoting component and the second pivoting component for engaging with the rear frame component for restraining pivoting movement of the one of the first pivoting component and the second pivoting component relative to the rear frame component.

Preferably, in an embodiment of the present invention, the chair frame further includes a lower frame component disposed between the front frame component and the rear frame component.

In summary, in the present invention, the adjustable leg rest can be adjusted between different positions relative to the chair frame for supporting the user's legs, especially the user's calves, at different angles. Furthermore, the adjustable backrest can be adjusted between different positions relative to the chair frame for supporting the user's back portion at different angles. Therefore, the present invention allows the user to sit with different gestures to reduce the pain in the user's back portion or legs. Furthermore, the present invention has advantages of easy operation and simplified structure.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
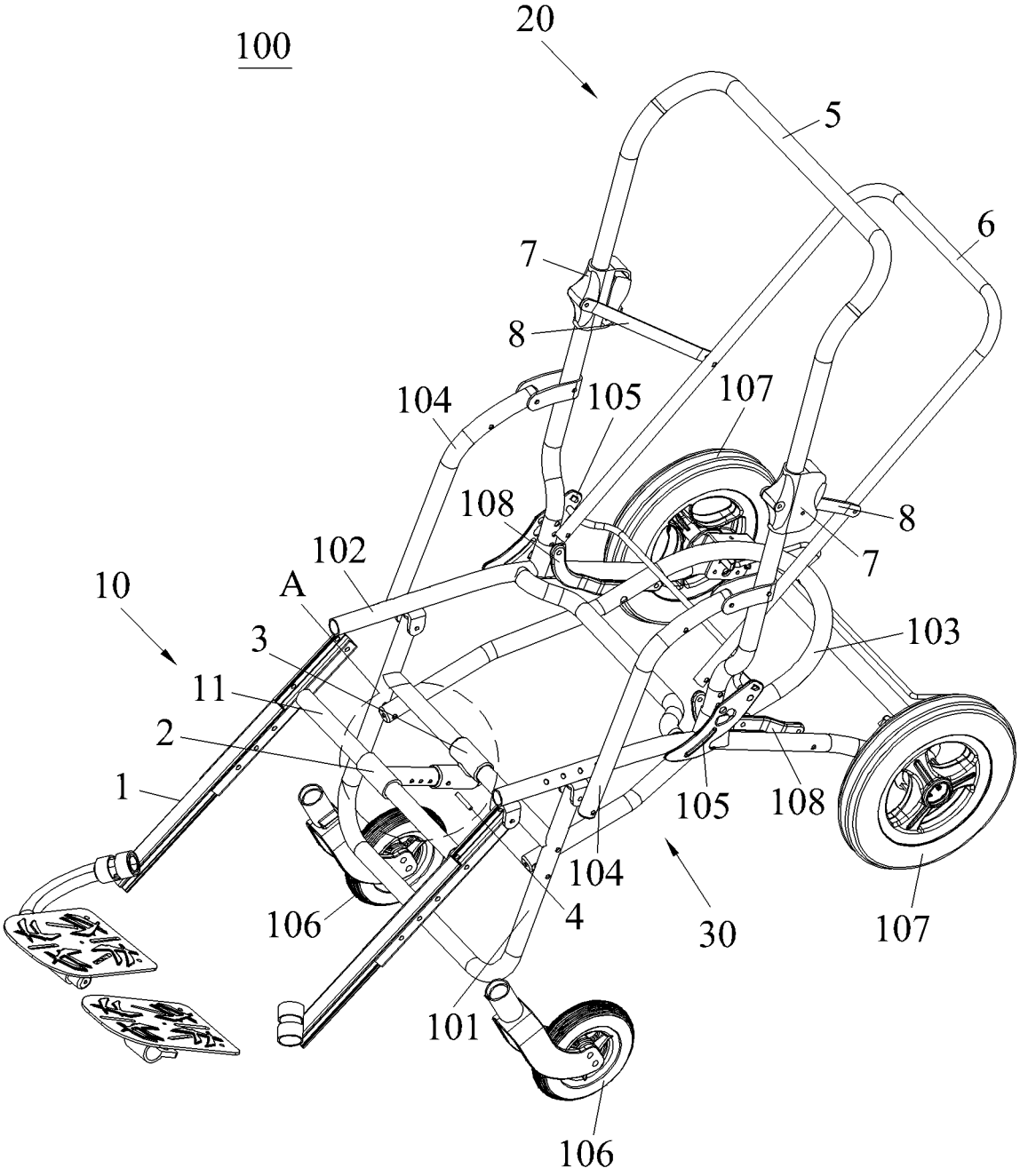
FIG. 1 is a schematic diagram of a wheelchair according to a first embodiment of the present invention.

Please refer to FIG. 1. FIG. 1 is a schematic diagram of a wheelchair 100 according to a first embodiment of the present invention. As shown in FIG. 1, the wheelchair 100 includes an adjustable leg rest 10, an adjustable backrest 20 and a chair frame 30. The adjustable leg rest 10 is disposed on the chair frame 30 and can be adjusted between different positions relative to the chair frame 30 for supporting a user's legs, especially the user's calves, at different angles. The adjustable backrest 20 is disposed on the chair frame 30 and can be adjusted between different positions relative to the chair frame 30 for supporting the user's back portion at different angles. In this embodiment, the chair frame 30 includes a front frame component 101, a rear frame component 102 and a lower frame component 103. The front frame component 101 is pivoted to a front end of the rear frame component 102. The lower frame component 103 is disposed between the front frame component 101 and the rear frame component 102 and pivoted to the front frame component 101. The rear frame component 102 and the lower frame component 103 cooperatively form a seat portion. However, the structure and the configuration of the chair frame are not limited to this embodiment. For example, in another embodiment, the chair frame can only include the front frame component and the rear frame component fixedly connected to the front frame component, i.e., the lower frame component can be omitted.

Figure 2:
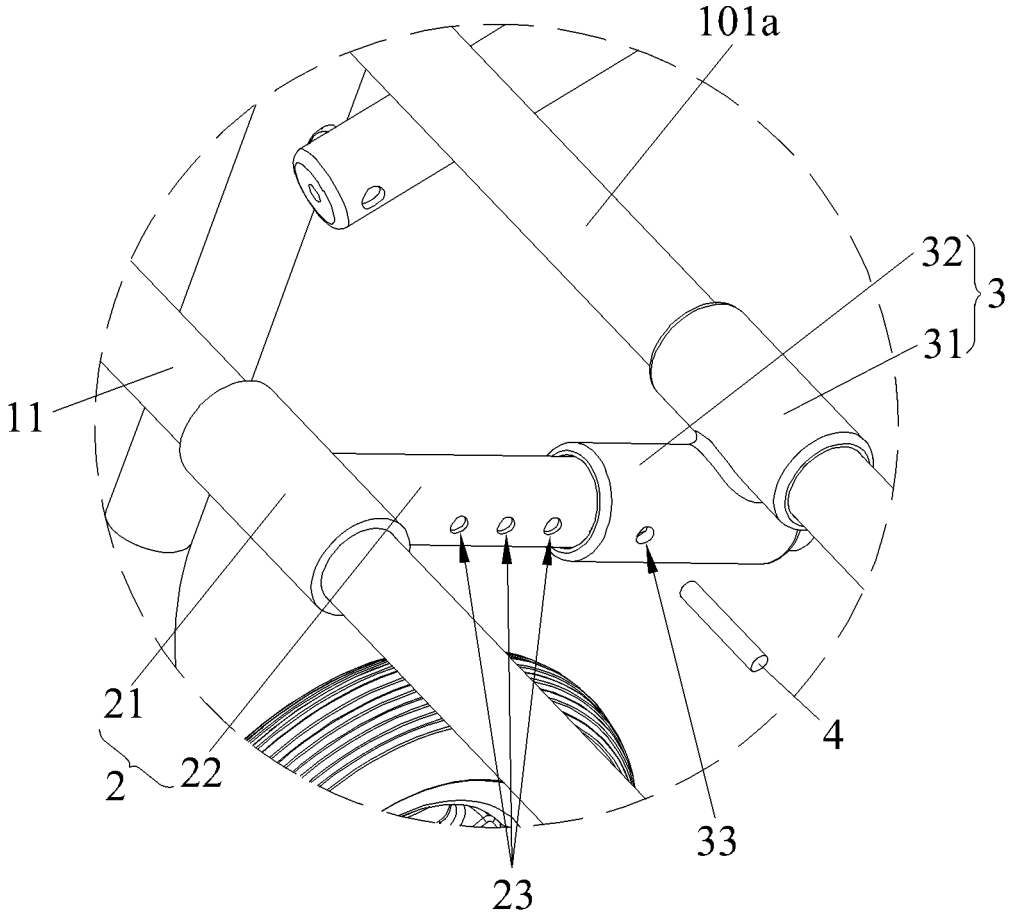
FIG. 2 is an enlarged diagram of an A portion of the wheelchair shown in FIG. 1 according to the first embodiment of the present invention.
Figure 3:
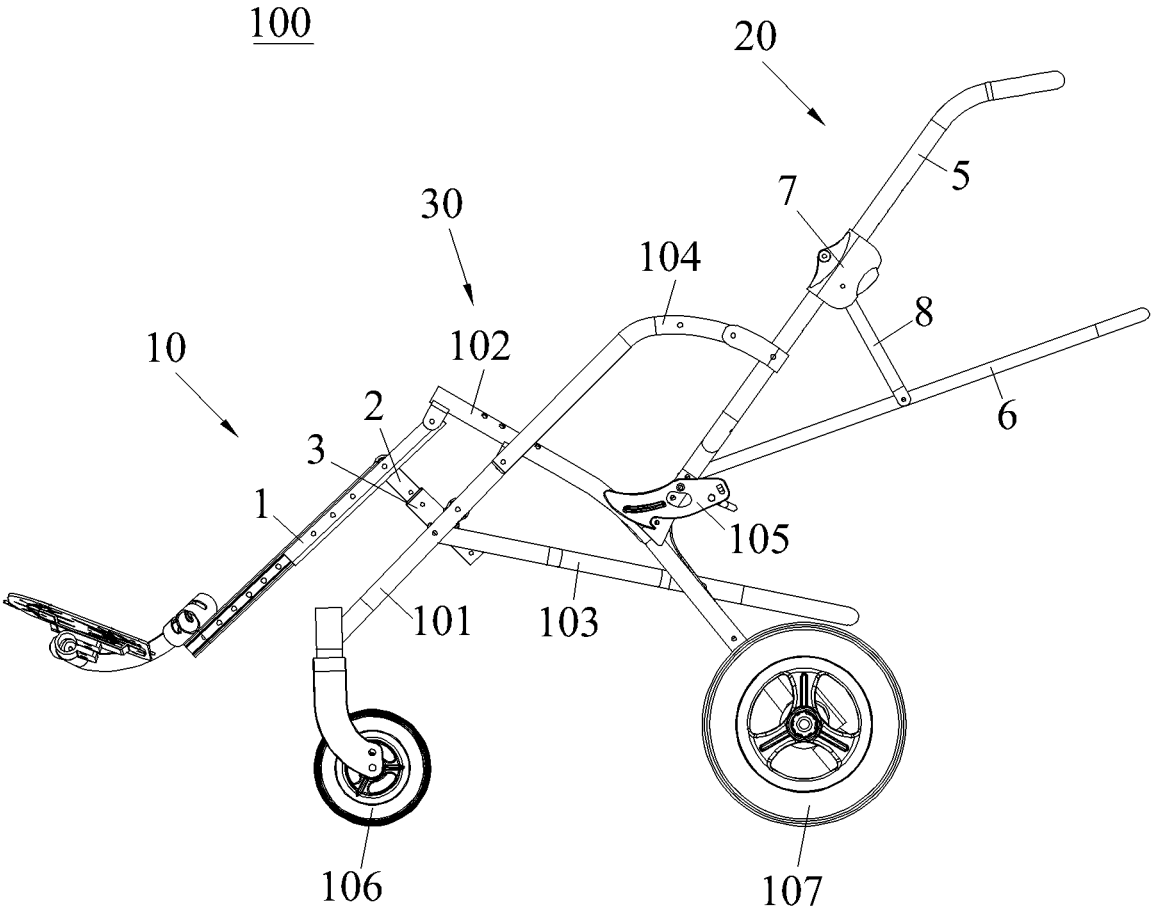
FIG. 3 is a diagram of the wheelchair in a first used state according to the first embodiment of the present invention.
Figure 4:
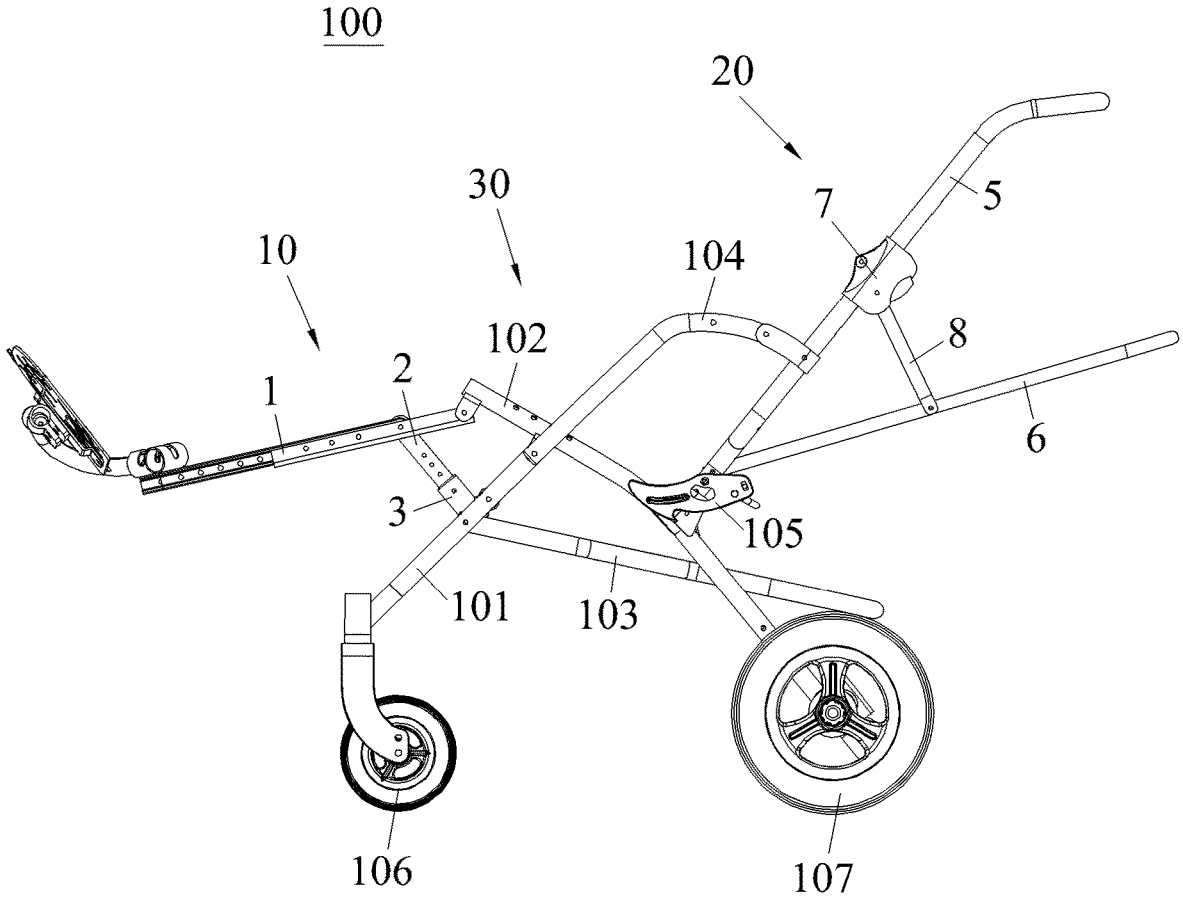
FIG. 4 is a diagram of the wheelchair in a second used state according to the first embodiment of the present invention.

Please refer to FIG. 1 to FIG. 4. FIG. 2 is an enlarged diagram of an A portion of the wheelchair 100 shown in FIG. 1 according to the first embodiment of the present invention. FIG. 3 is a diagram of the wheelchair 100 in a first used state according to the first embodiment of the present invention. FIG. 4 is a diagram of the wheelchair 100 in a second used state according to the first embodiment of the present invention. As shown in FIG. 1 to FIG. 4, the adjustable leg rest 10 includes a leg rest supporting component 1, a first sliding component 2 and a rotating component 3. The leg rest supporting component 1 is pivoted to the chair frame 30. The rotating component 3 is rotatably connected to the chair frame 30. Specifically, the leg rest supporting component 1 is pivoted to the rear frame component 102 and located in front of the front frame component 101. The rotating component 3 is rotatably connected to the front frame component 101. A first end of the first sliding component 2 is slidably disposed on the rotating component 3. A second end of the first sliding component 2 is connected to the leg rest supporting component 1. The leg rest supporting component 1 can pivot relative to the rear frame component 102 of the chair frame 30 by cooperation of rotary movement of the rotating component 3 relative to the front frame component 101 of the chair frame 30 and sliding movement of the first sliding component 2 relative to the rotating component 3.

In this embodiment, the first sliding component 2 includes a sleeve portion 21 and a sliding portion 22 protruding from the sleeve portion 21. The rotating component 3 includes a rotating portion 31 and an inserting portion 32 fixedly connected to the rotating portion 31. The sleeve portion 21 is rotatably sleeved on the leg rest supporting component 1. The sliding portion 22 is inserted into the inserting portion 32 and slidable relative to the inserting portion 32. The rotating portion 31 is rotatably connected to the front frame component 101 of the chair frame 30. In detail, the leg rest supporting component 1 includes a first traversal rod 11, and the sleeve portion 21 of the first sliding component 2 is rotatably sleeved on the first traversal rod 11. The front frame component 101 includes a second traversal rod 101*a*, and the rotating portion 31 of the rotating component 3 is rotatably sleeved on the second traversal rod 101*a*.

As shown in FIG. 2, in order to achieve a purpose of positioning the leg rest supporting component 1 at a desired position relative to the chair frame 30, the adjustable leg rest 10 further includes a first locking component 4 removably disposed between the first sliding component 2 and the rotating component 3 and for restraining the sliding movement of the first sliding component 2 relative to the rotating component 3 and the rotary movement of the rotating component 3 relative to the front frame component 101 of the chair frame 30. Specifically, a plurality of first inserting holes 23 is formed on the first sliding component 2 at intervals. A second inserting hole 33 is formed on the rotating component 3. The first locking component 4 can be an inserting pin. The sliding movement of the first sliding component 2 relative to the rotating component 3 and the rotary movement of the rotating component 3 relative to the front frame component 101 of the chair frame 30 are allowed by removal of the first locking component 4 from a corresponding one of the plurality of first inserting holes 23 and the second inserting hole 33. When the leg rest supporting component 1 is operated to pivot to the desired position relative to the chair frame 30, the first sliding component 2 slides relative to the rotating component 3, and the rotating component 3 rotates relative to the front frame component 101 of the chair frame 30. After the leg rest supporting component 1 is located at the desired position relative to the chair frame 30, the sliding movement of the first sliding component 2 relative to the rotating component 3 and the rotary movement of the rotating component 3 relative to the front frame component 101 can be restrained by insertion of the first locking component 4 into a corresponding one of the plurality of first inserting holes 23 and the second inserting hole 33 for restraining pivoting movement of the leg rest supporting component 1 relative to the chair frame 30, so as to achieve the purpose of positioning the leg rest supporting component 1 at the desired position relative to the chair frame 30. However, the present invention is not limited to this embodiment. For example, in another embodiment, there can be only one first inserting hole formed on the first sliding component, and there can be a plurality of second inserting holes formed on the rotating component.

As shown in FIG. 2 to FIG. 4, detailed description of operational principle of the adjustable leg rest 10 is provided as follows. When it is desired to adjust the adjustable leg rest 10 from a state as shown in FIG. 3 to a state as shown in FIG. 4, the first locking component 4 can be removed from a corresponding one of the plurality of first inserting holes 23 and the second inserting hole 33 to allow the sliding movement of the first sliding component 2 relative to the rotating component 3 and the rotary movement of the rotating component 3 relative to the second traversal rod 101*a* of the front frame component 101. Afterwards, the leg rest supporting component 1 can be pulled upwardly to pivot relative to the chair frame 30 by cooperation of the sliding movement of the first sliding component 2 relative to the rotating component 3 and the rotary movement of the rotating component 3 relative to the second traversal rod 101*a* of the front frame component 101 of the chair frame 30. After the leg rest supporting component 1 pivots to a position as shown in FIG. 4, the first locking component 4 can be inserted into a corresponding one of the plurality of first inserting holes 23 and the second inserting hole 33 to restrain the sliding movement of the first sliding component 2 relative to the rotating component 3 and the rotary movement of the rotating component 3 relative to the second traversal rod 101*a* of the front frame component 101 for achieving the purpose of positioning the leg rest supporting component 1 relative to the chair frame 30. Furthermore, adjusting the adjustable leg rest 10 from the state as shown in FIG. 4 to the state as shown in FIG. 3 can be achieved by the removal of the first locking component 4, the pivoting movement of the leg rest supporting component 1 relative to the chair frame 30, and insertion of the first locking component 4. Detailed description is omitted herein.

Figure 5:
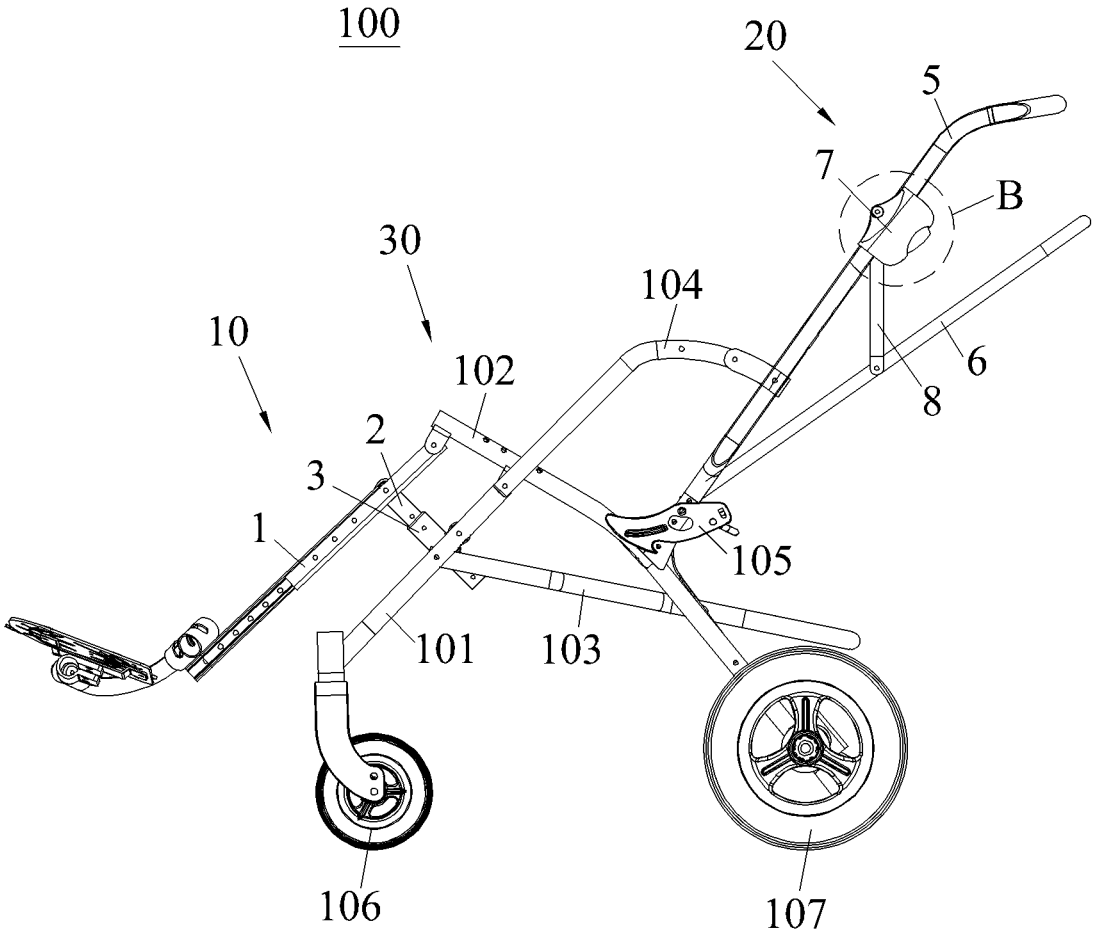
FIG. 5 is a diagram of the wheelchair in a third used state according to the first embodiment of the present invention.
Figure 6:
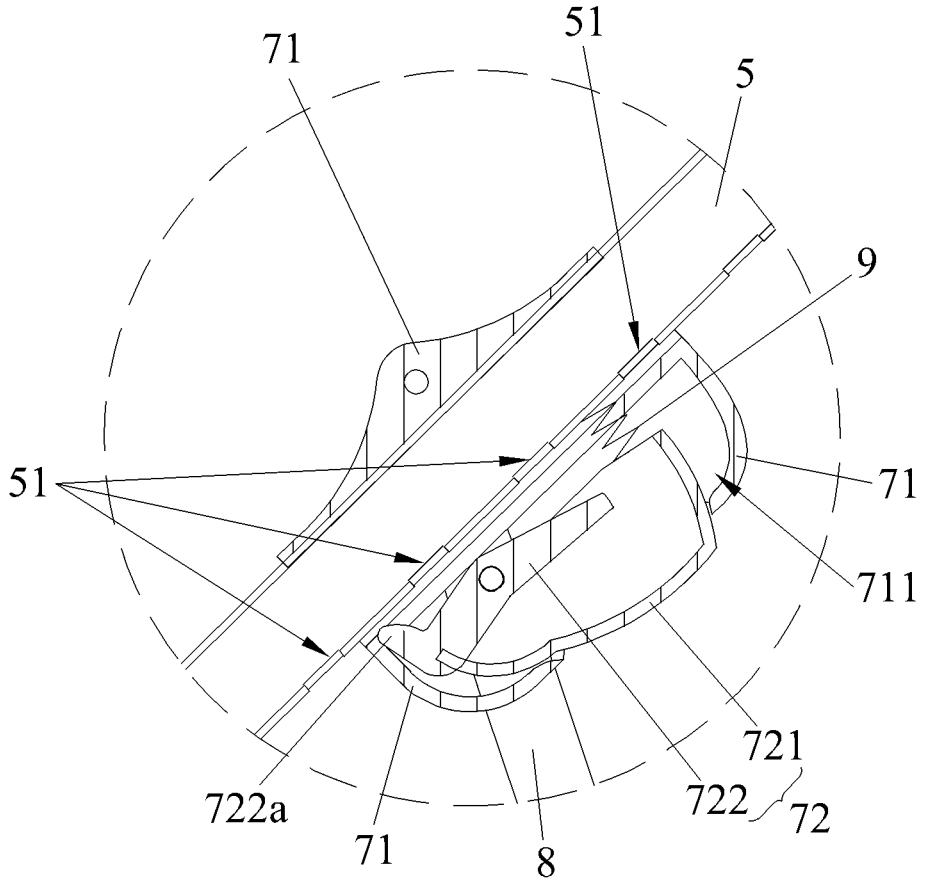
FIG. 6 is an enlarged diagram of a B portion of the wheelchair shown in FIG. 5 according to the first embodiment of the present invention.

Please refer to FIG. 1, FIG. 3, FIG. 5 and FIG. 6. FIG. 5 is a diagram of the wheelchair 100 in a third used state according to the first embodiment of the present invention. FIG. 6 is an enlarged diagram of a B portion of the wheelchair 100 shown in FIG. 5 according to the first embodiment of the present invention. As shown in FIG. 1, FIG. 3, FIG. 5 and FIG. 6, the adjustable backrest 20 includes a first pivoting component 5, a second pivoting component 6, two backrest sliding assemblies 7 and two backrest connecting components 8. The two backrest sliding assemblies 7 and the two backrest connecting components 8 of the adjustable backrest 20 are located on two lateral sides of the adjustable backrest 20. For simplicity, detailed description of the adjustable backrest 20 at one side is provided as follows, and the adjustable backrest 20 at the other side has the same structure and operational mechanism. In this embodiment, the second pivoting component 6 is used as a backrest supporting component for supporting the user's back portion, and the first pivoting component 5 is used as a handle for a caregiver to pull or push the wheelchair 100. The first pivoting component 5 is pivoted to the rear frame component 102 and located above the rear frame component 102. The second pivoting component 6 is pivoted to the first pivoting component 5. The backrest sliding assembly 7 is slidably disposed on the first pivoting component 5. The backrest connecting component 8 is disposed between the first pivoting component 5 and the second pivoting component 6. A first end of the backrest connecting component 8 is pivoted to the backrest sliding assembly 7. A second end of the backrest connecting component 8 is pivoted to the second pivoting component 6. The backrest connecting component 8 can be driven to drive the second pivoting component 6 to pivot relative to the first pivoting component 5 by sliding movement of the backrest sliding assembly 7 relative to the first pivoting component 5. However, the present invention is not limited to this embodiment. For example, in another embodiment, the second pivoting component can be used as the handle and pivotally disposed on the chair frame 30, and the first pivoting component can be used as the backrest supporting component pivoted to the second pivoting component. In other words, one of the first pivoting component and the second pivoting component can be used as the handle pivotally connected to the chair frame, and the other one of the first pivoting component and the second pivoting component can be used as the backrest supporting component pivoted to the one of the first pivoting component and the second pivoting component. Alternatively, in another embodiment, the adjustable backrest can include only one backrest sliding assembly and one backrest connecting component at one side.

Specifically, the backrest sliding assembly 7 includes a backrest shell 71 and a backrest releasing operating component 72. The backrest shell 71 is slidably disposed on the first pivoting component 5. The backrest releasing operating component 72 is pivoted to the backrest shell 71. A plurality of backrest engaging holes 51 is formed on the first pivoting component 5 at intervals. The backrest releasing operating component 72 can pivotally engage with a corresponding one of the plurality of backrest engaging holes 51 for preventing the sliding movement of the backrest sliding assembly 7 relative to the first pivoting component 5 or pivotally disengage from a corresponding one of the plurality of backrest engaging holes 51 for allowing the sliding movement of the backrest sliding assembly 7 relative to the first pivoting component 5. In detail, the backrest shell 71 is slidably sleeved on the first pivoting component 5. A backrest accommodating chamber 711 is formed in the backrest shell 71. A backrest opening is formed on the backrest shell 71 and communicated with the backrest accommodating chamber 711. The backrest releasing operating component 72 is at least partially disposed inside the backrest accommodating chamber 711.

In this embodiment, the backrest releasing operating component 72 includes a backrest operating portion 721 and a backrest engaging portion 722 fixed with the backrest operating portion 721. The backrest operating portion 721 can be a button structure partially exposed out of the backrest shell 71 via the backrest opening for providing easy access to operate. The backrest engaging portion 722 is pivoted to the backrest shell 71. A protrusion 722*a* protrudes from the backrest engaging portion 722 for engaging with a corresponding one of the plurality of backrest engaging holes 51. The backrest engaging portion 722 can be driven to pivotally engage with or disengage from a corresponding one of the plurality of backrest engaging holes 51 by operation of the backrest operating portion 721.

Furthermore, in order to resiliently recover the backrest releasing operating component 72 to engage the protrusion 722*a* with a corresponding one of the plurality of backrest engaging holes 51 after releasing the backrest releasing operating component 72, the backrest sliding assembly 7 further includes a backrest resilient component 9. A middle portion of the backrest releasing operating component 72 is pivoted to the backrest shell 71. The backrest resilient component 9 is disposed inside the backrest accommodating chamber 711 and located between the first pivoting component 5 and an abutting end of the backrest releasing operating component 72 to bias an engaging end of the backrest releasing operating component 72, whereon the protrusion 722*a* is formed, to engage with a corresponding one of the plurality of backrest engaging holes 51. Preferably, the backrest resilient component 9 is a compression spring. However, it is not limited thereto. For example, the backrest resilient component can be a torsional spring, a leaf spring or any other resilient structure.

As shown in FIG. 3, FIG. 5 and FIG. 6, detailed description of operational principle of the adjustable backrest 20 is provided as follows. When it is desired to adjust the adjustable backrest 20 from a state as shown in FIG. 3 to a state as shown in FIG. 5, the backrest releasing operating component 72 can be pressed to pivot, so that the abutting end of the backrest releasing operating component 72 is driven to resiliently compress the backrest resilient component 9, and the engaging end of the backrest releasing operating component 72 is driven to disengage from a corresponding one of the plurality of backrest engaging holes 51 for allowing the sliding movement of the backrest sliding assembly 7 relative to the first pivoting component 5. When the backrest sliding assembly 7 is operated to slide relative to the first pivoting component 5, the backrest sliding assembly 7 drives the second pivoting component 6, which is used as the backrest supporting component, to pivot relative to the first pivoting component 5, which is used as the handle, by the backrest connecting component 8, so as to achieve a purpose of adjusting the adjustable backrest 20 from the state as shown in FIG. 3 to the state as shown in FIG. 5. After the adjustable backrest 20 is adjusted to the state as shown in FIG. 5, the backrest releasing operating component 72 can be released, so that the backrest releasing operating component 72 is driven to recover by the resiliently compressed backrest resilient component 9 to engage the engaging end of the backrest releasing operating component 72 with a corresponding one of the plurality of backrest engaging holes 51 for restraining the sliding movement of the backrest sliding assembly 7 relative to the first pivoting component 5 so as to achieve a purpose of positioning the adjustable backrest 20 in the state as shown in FIG. 5. Furthermore, adjusting the adjustable leg rest 10 from the state as shown in FIG. 5 to the state as shown in FIG. 3 can be achieved by disengagement of the backrest releasing operating component 72 from a corresponding one of the plurality of backrest engaging holes 51, the sliding movement of the backrest sliding assembly 7 relative to the first pivoting component 5, and engagement of the backrest releasing operating component 72 and a corresponding one of the plurality of backrest engaging holes 51. Detailed description is omitted herein.

Figure 7:
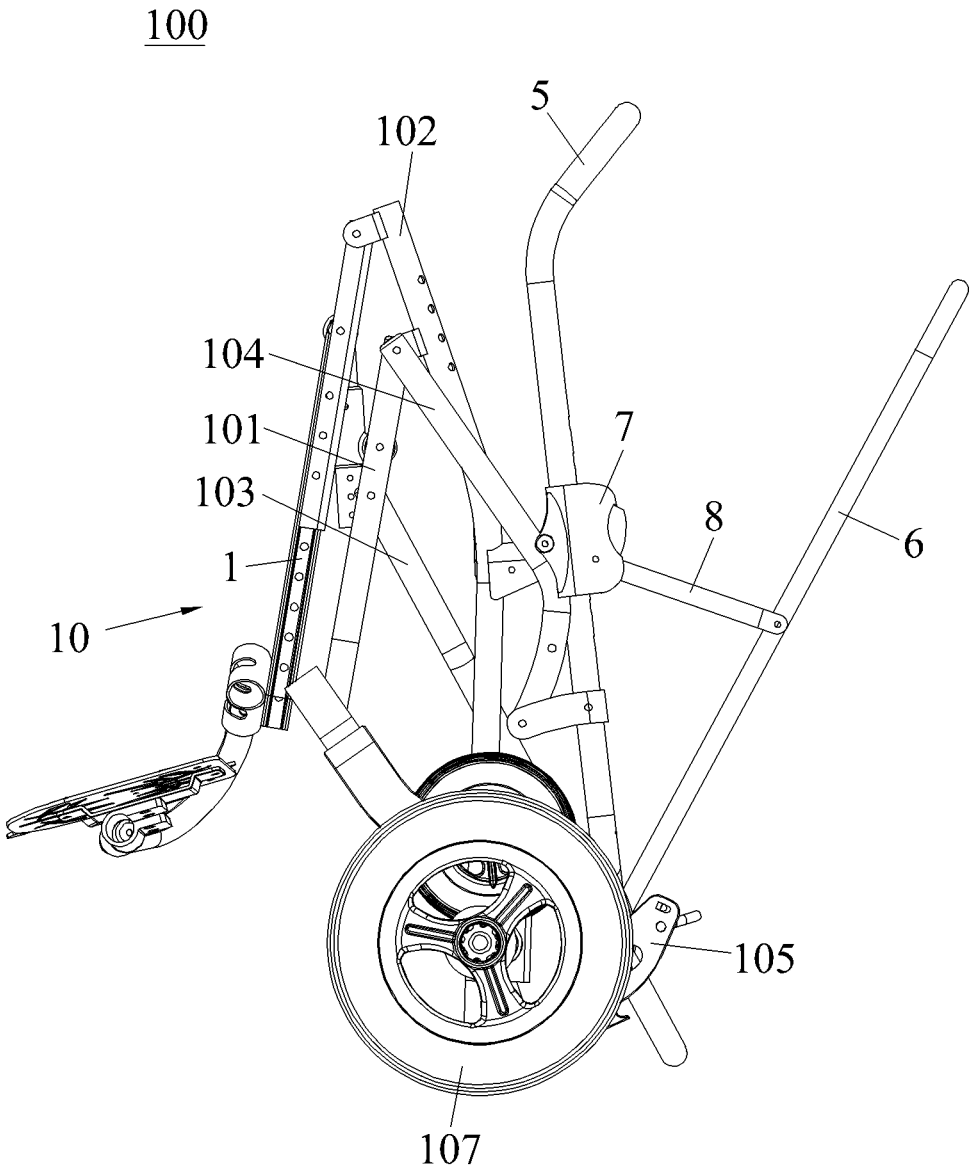
FIG. 7 is a diagram of the wheelchair in a folded state according to the first embodiment of the present invention.

As shown in FIG. 1 and FIG. 7, the chair frame 30 further includes two handrails 104, two frame restraining components 105 and two handrail connecting components 108. The two handrails 104, the two frame restraining components 105 and the two handrail connecting components 108 are located on the two lateral sides of the wheelchair 100. Detailed description of the handrail 104, the frame restraining component 105 and the handrail connecting component 108 at one side is provided as follows, and the handrail 104, the frame restraining component 105 and the handrail connecting component 108 at the other side have the same structure and operational mechanism. The handrail 104 is disposed between the first pivoting component 5 and the rear frame component 102. A first end of the handrail 104 is pivoted to the rear frame component 102. A second end of the handrail 104 is pivoted to the first pivoting component 5. The handrail connecting component 108 is disposed between the first pivoting component 5 and the rear frame component 102. A first end of the handrail connecting component 108 is pivoted to the rear frame component 102, and a second end of the handrail connecting component 108 is pivoted to the first pivoting component 5. The frame restraining component 105 is pivoted to the first pivoting component 5. An engaging portion, which is not shown in the figures, is formed on the rear frame component 102 for engaging with the frame restraining component 105. The frame restraining component 105 can engage with the engaging portion to restrain pivoting movement of the first pivoting component 5 relative to the rear frame component 102, so as to achieve a purpose of restraining a folding action of the whole wheelchair 100.

When the frame restraining component 105 is operated to disengage from the engaging portion, the first pivoting component 5 is allowed to pivot relative to the rear frame component 102. When the first pivoting component 5 pivots relative to the rear frame component 102, the first pivoting component 5 can drive the rear frame component 102 to pivot relative to the front frame component 101 by the handrail connecting component 108 and the handrail 104. In other words, when the frame restraining component 105 is operated to disengage from the engaging portion, the adjustable leg rest 10 and the front frame component 101 are allowed to fold relative to the rear frame component 102 along a counter clockwise direction, and the first pivoting component 5 and the second pivoting component 6 are allowed to fold relative to the rear frame component 102 along a clockwise direction, so as to achieving the folding action of the whole wheelchair 100. However, the present invention is not limited to this embodiment. For example, in another embodiment, the handrail, the frame restraining component and the handrail connecting component can be omitted selectively according to practical demands. Alternatively, in another embodiment, the chair frame can include one handrail, one frame restraining component and one handrail connecting component at one side. Besides, the wheelchair 100 further includes two front wheels 106 pivoted to the front frame component 101 and two rear wheels 107 pivoted to the rear frame component 102.

Figure 8:
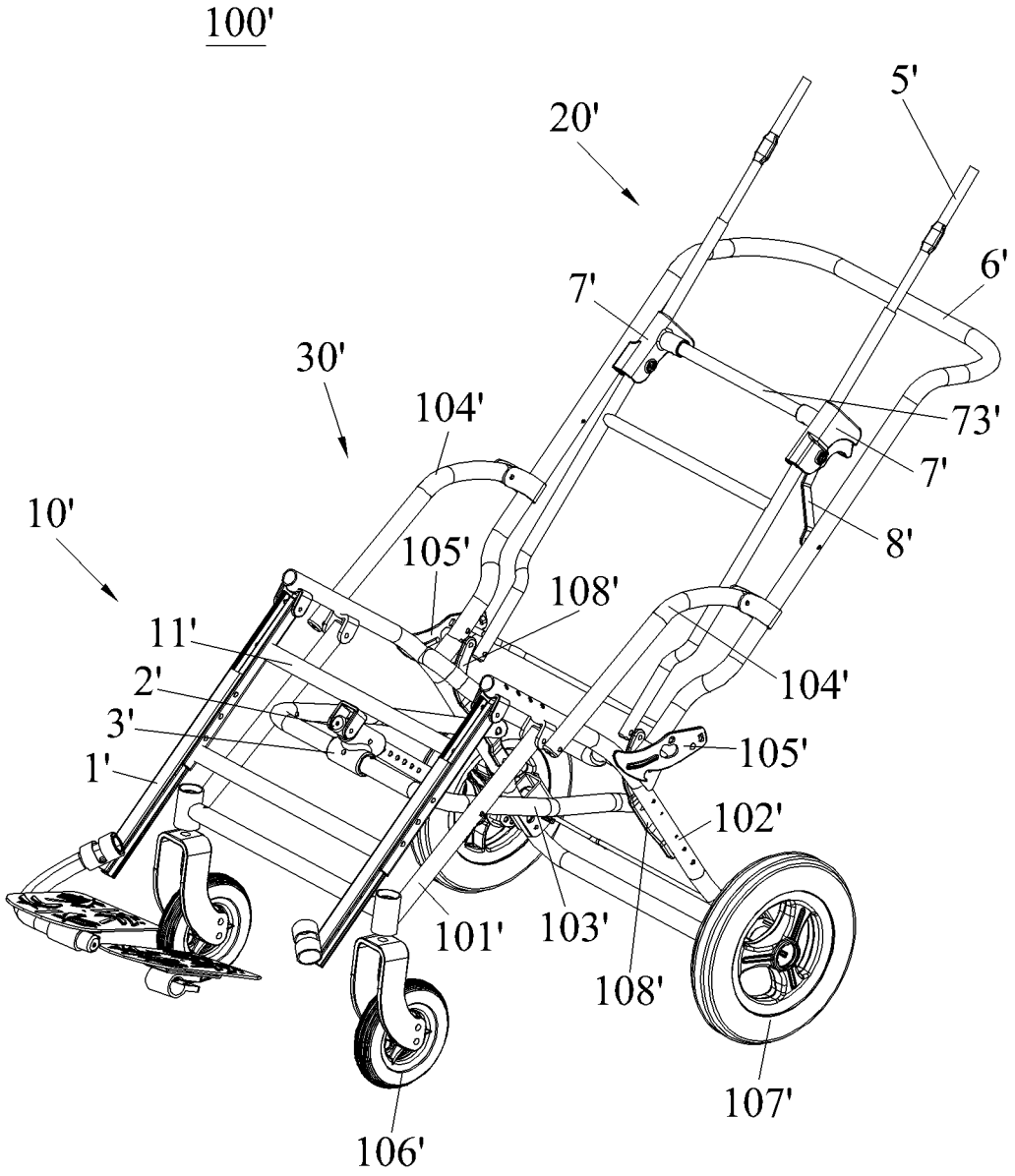
FIG. 8 is a schematic diagram of a wheelchair according to a second embodiment of the present invention.
Figure 9:
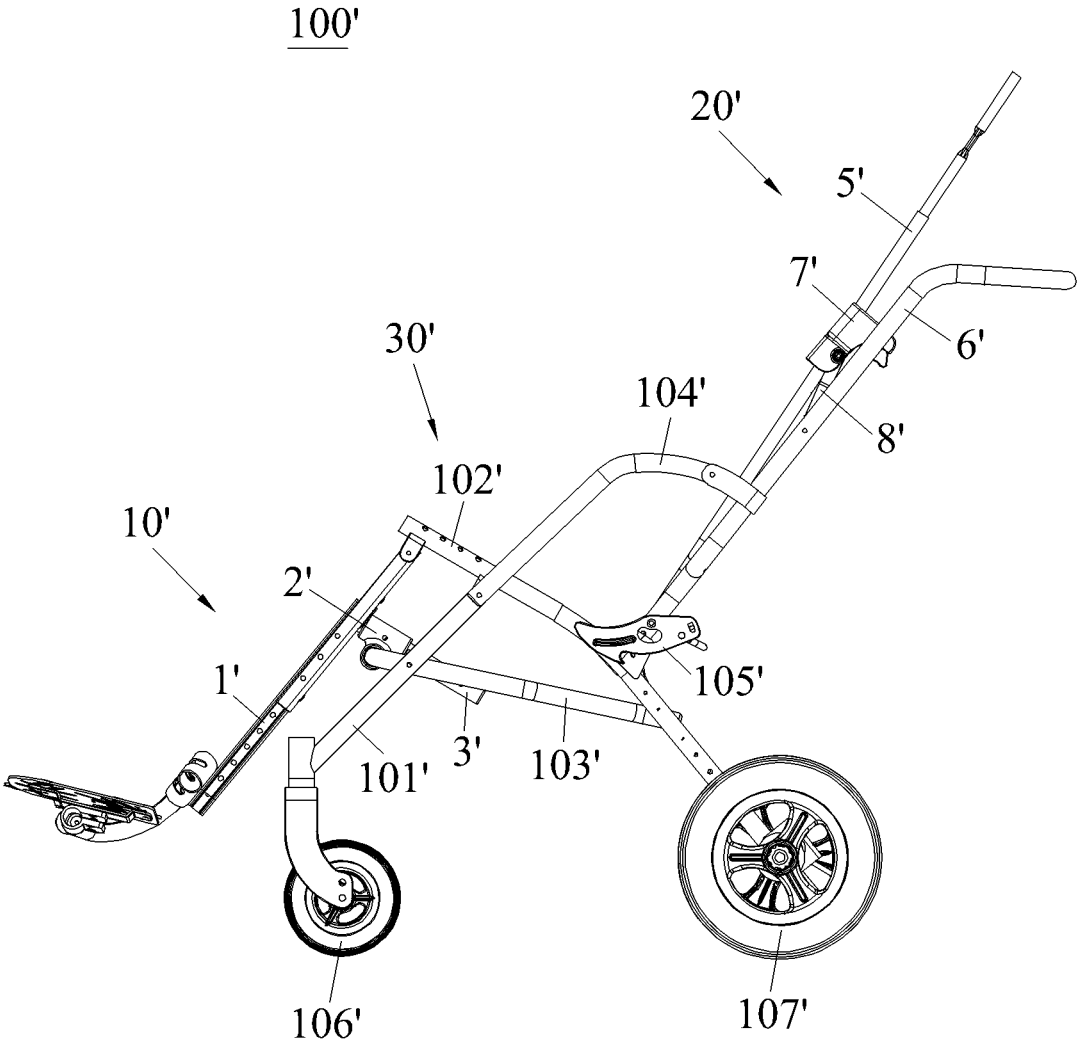
FIG. 9 and FIG. 10 are diagrams of the wheelchair in different used states according to the second embodiment of the present invention.
Figure 10:
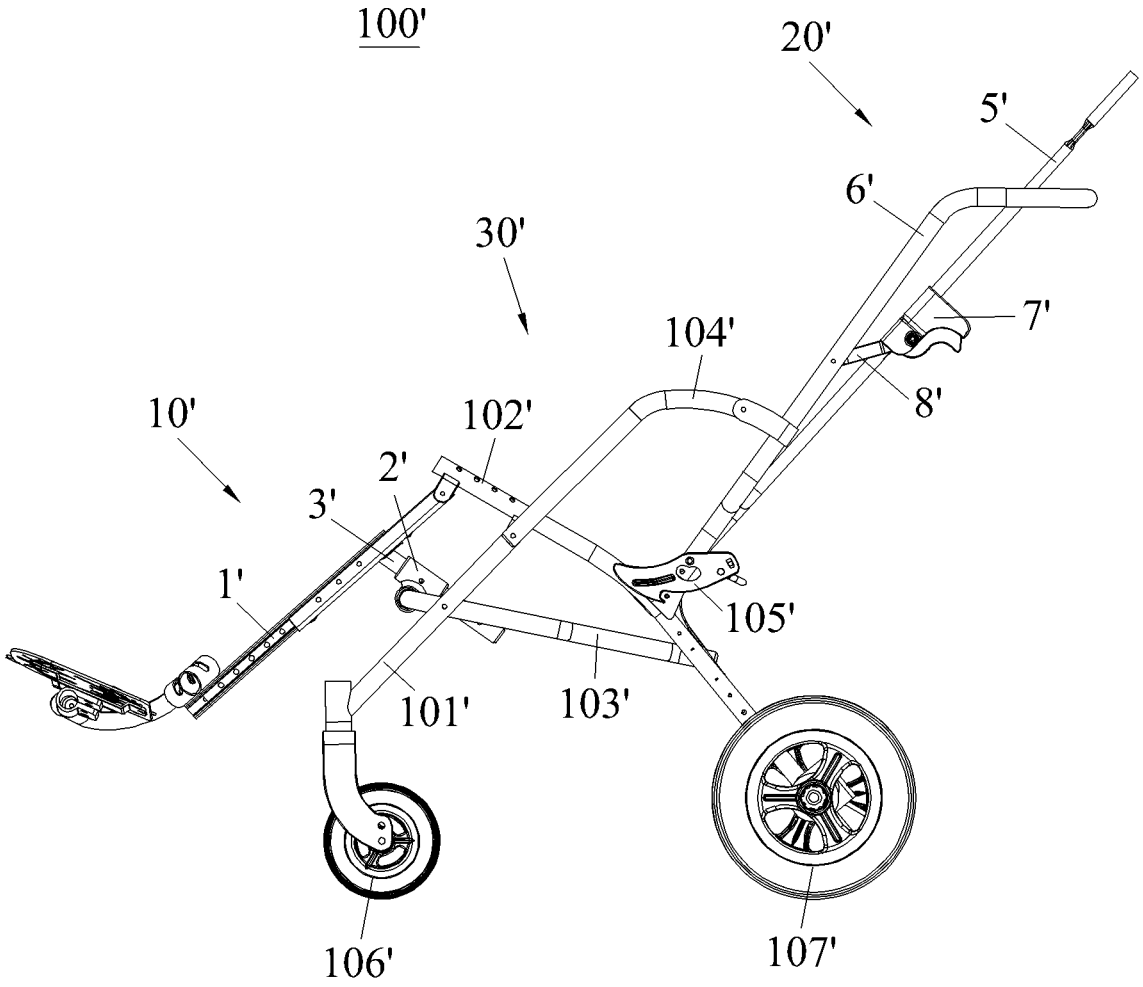

Please refer to FIG. 8 to FIG. 10. FIG. 8 is a schematic diagram of a wheelchair 100' according to a second embodiment of the present invention. FIG. 9 and FIG. 10 are diagrams of the wheelchair 100' in different used states according to the second embodiment of the present invention. As shown in FIG. 8 to FIG. 10, the wheelchair 100' includes an adjustable leg rest 10', an adjustable backrest 20' and a chair frame 30'. Structures of the adjustable leg rest 10' and the chair frame 30' of this embodiment are similar to the ones of the first embodiment, and detailed description thereof is omitted herein for simplicity.

Different from the adjustable backrest 20 of the first embodiment, the adjustable backrest 20' includes a first pivoting component 5', a second pivoting component 6', two backrest sliding assemblies 7' and two backrest connecting components 8'. In this embodiment, the first pivoting component 5' can be used as the backrest supporting component for supporting the user's back portion and pivoted to the second pivoting component 6', and the second pivoting component 6' can be used as the handle and pivoted to a rear frame component 102 of the chair frame 30' and located above the rear frame component 102'. Furthermore, in order to facilitate operation of two backrest releasing operating components, which are not shown in the figures, of the two backrest sliding assemblies 7', the adjustable backrest 20' further includes an operating rod 73' fixedly connected to the two backrest releasing operating components. Specifically, two ends of the operating rod 73' are respectively fixedly connected to two backrest operating portions, which are formed in button structures, of the two backrest releasing operating components. The user can drive the two backrest releasing operating components to pivotally disengage the engaging ends of the two backrest releasing operating components from two corresponding backrest engaging holes, which are not shown in the figures, or engage the two engaging ends with the two corresponding engaging holes by operating the operating rod 73' with one hand.

When it is desired to adjust the adjustable backrest 20', the backrest releasing operating component of the backrest sliding assembly 7' can be driven to pivot by operating the operating rod 73', so that an abutting end of the backrest releasing operating component is driven to resiliently compress a backrest resilient component, which is not shown in the figures, and an engaging end of the backrest releasing operating component is driven to disengage from a corresponding one of the plurality of backrest engaging holes for allowing the sliding movement of the backrest sliding assembly 7' relative to the first pivoting component 5'. When the backrest sliding assembly 7' is operated to slide relative to the first pivoting component 5', the backrest sliding assembly 7' drives the first pivoting component 5', which is used as the backrest supporting component, to pivot relative to the second pivoting component 6', which is used as the handle, by the backrest connecting component 8', so as to achieve a purpose of adjusting the adjustable backrest 20'. After adjustment of the adjustable backrest 20', the operating rod 73' can be released, so that the backrest releasing operating component is driven to recover by the resiliently compressed backrest resilient component to engage the engaging end of the backrest releasing operating component with a corresponding one of the plurality of backrest engaging holes for restraining the sliding movement of the backrest sliding assembly 7' relative to the first pivoting component 5', so as to achieve a purpose of positioning the adjustable backrest 20'.

Figure 11:
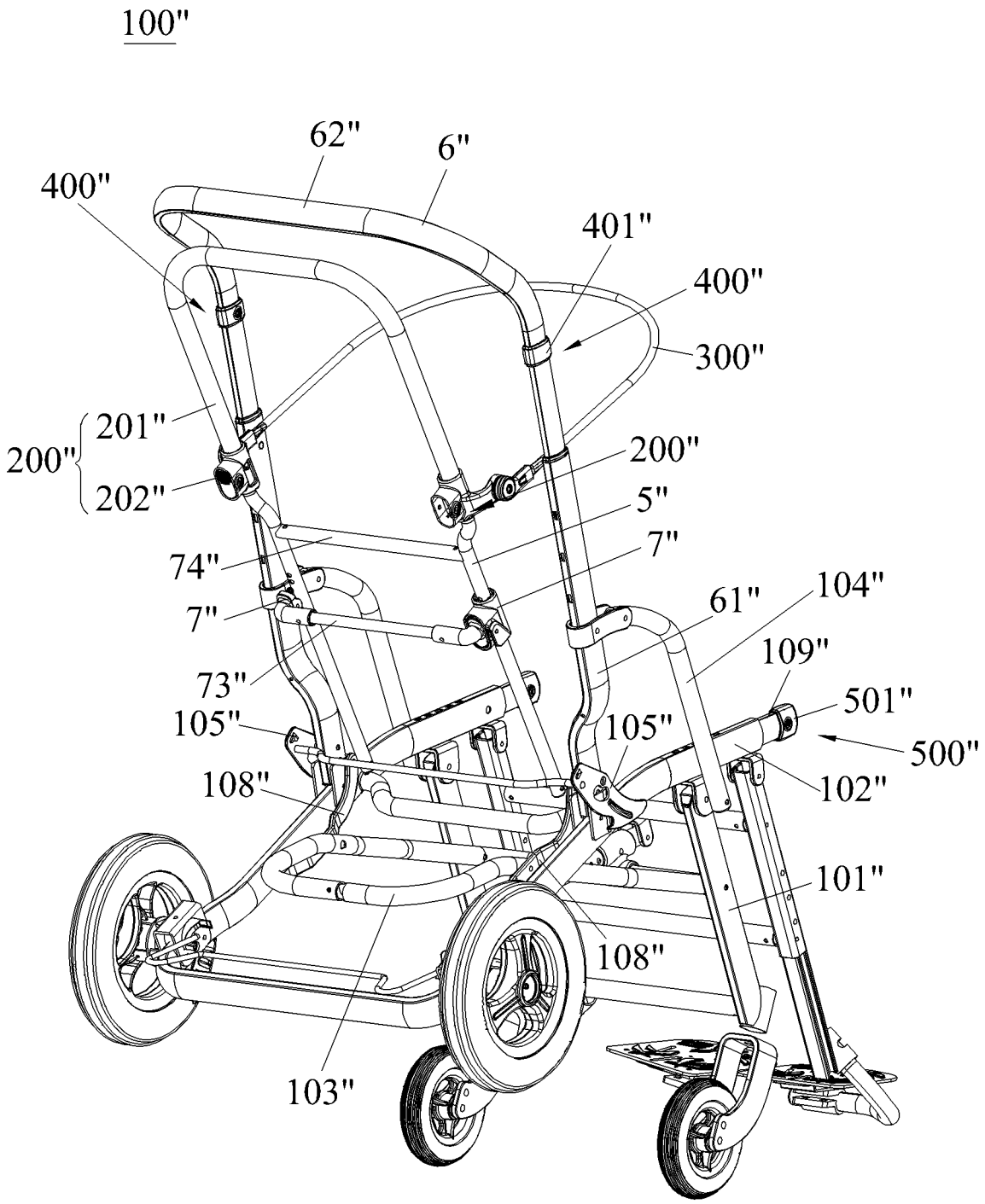
FIG. 11 and FIG. 12 are partial diagrams of a wheelchair at different views according to a third embodiment of the present invention.
Figure 12:
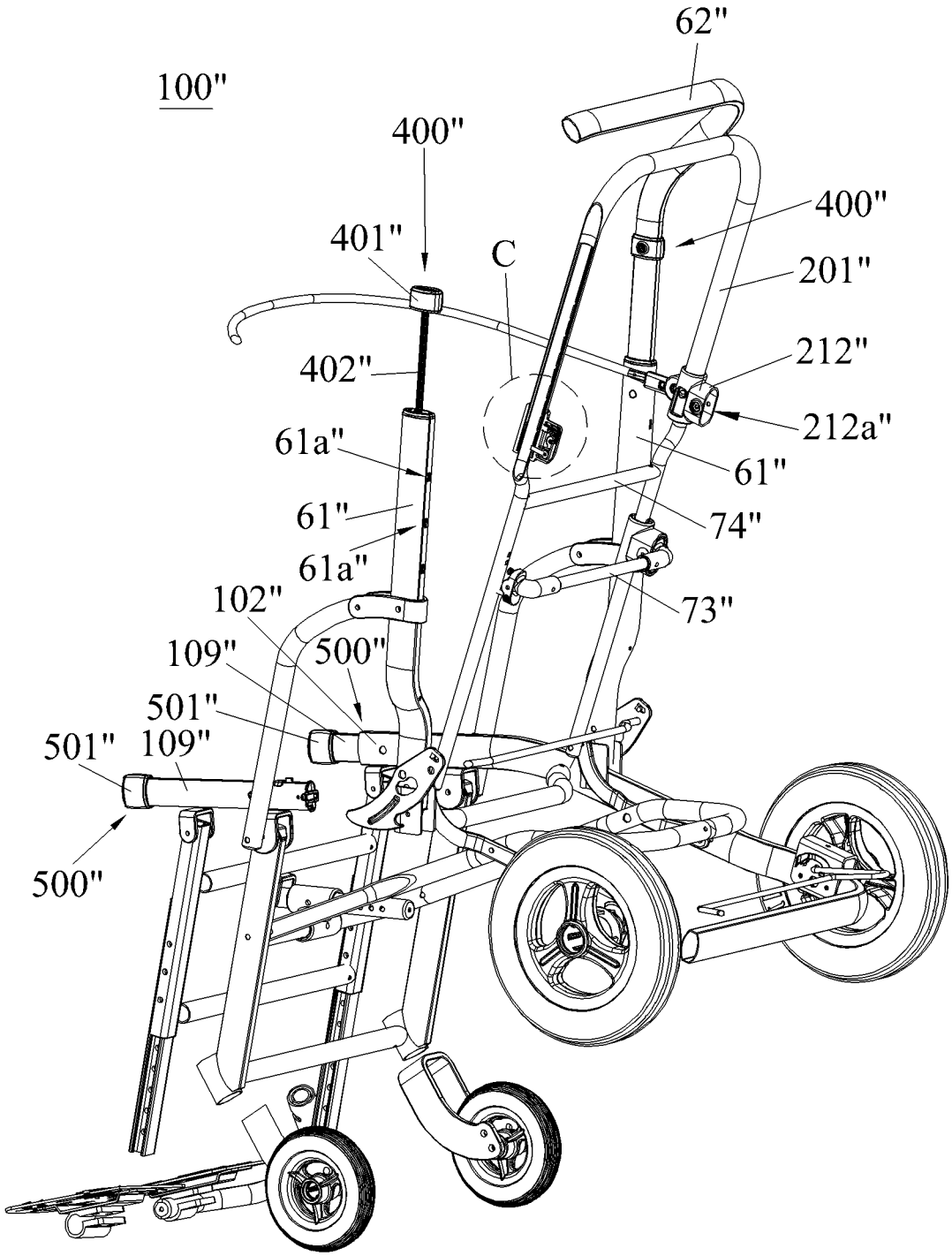

Please refer to FIG. 11 to FIG. 12. FIG. 11 and FIG. 12 are partial diagrams of a wheelchair 100" at different views according to a third embodiment of the present invention. As shown in FIG. 11 to FIG. 12, the wheelchair 100" includes an adjustable leg rest 10", an adjustable backrest 20" and a chair frame 30". Different from the aforementioned embodiments, in this embodiment, in order to facilitate one hand operation of an operating rod 73", the adjustable backrest 20" includes an auxiliary rod 74" disposed on a first pivoting component 5" and for cooperating with the operating rod 73" for driving a backrest releasing operating component, which is not shown in the figures, of a backrest sliding assembly 7" to pivot, so that the user can operate the operating rod 73" with one hand by placing a thumb on the auxiliary rod 74" and four fingers on the operating rod 73".

Figure 13:
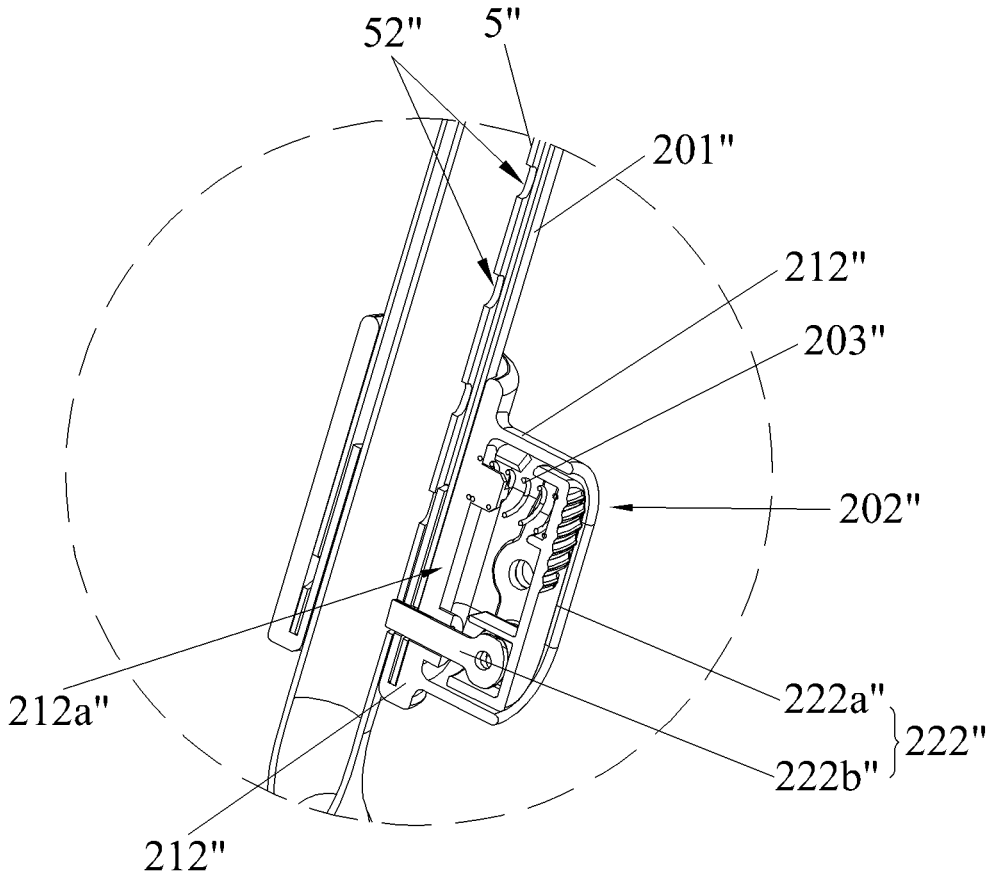
FIG. 13 is an enlarged diagram of a C portion of the wheelchair shown in FIG. 12 according to the third embodiment of the present invention.

Please refer to FIG. 12 and FIG. 13. FIG. 13 is an enlarged diagram of a C portion of the wheelchair 100" shown in FIG. 12 according to the third embodiment of the present invention. As shown in FIG. 12 and FIG. 13, the wheelchair 100" further includes an adjustable headrest 200". The adjustable headrest 200" includes a headrest supporting component 201" and two headrest sliding assemblies 202". The two headrest sliding assemblies 202" are located at two lateral sides of the adjustable headrest 200". Detailed description of the adjustable headrest 200" at one side is provided as follows, and the adjustable headrest 200" at the other side has the same structure and operational mechanism. The headrest supporting component 201" is installed on the headrest sliding assembly 202". The headrest sliding assembly 202" is slidably disposed on the backrest supporting component, i.e., the first pivoting component 5" of the adjustable backrest 20". A height or a position of the headrest supporting component 201" can be adjusted by sliding movement of the headrest sliding assembly 202" relative to the first pivoting component 5". However, the present invention is not limited to this embodiment. For example, in another embodiment, the headrest sliding assembly can be slidably disposed on the second pivoting component when the second pivoting component and the first pivoting component are respectively used as the backrest supporting component and the handle. Alternatively, in another embodiment, the adjustable headrest can include only one headrest sliding assembly at one side.

Specifically, the headrest sliding assembly 202" includes a headrest shell 212" and the headrest releasing operating component 222". The headrest shell 212" is slidably disposed on the first pivoting component 5" of the adjustable backrest 20". The headrest releasing operating component 222" is pivoted to the headrest shell 212". A plurality of headrest engaging holes 52" is formed on the first pivoting component 5" of the adjustable backrest 20" at intervals. The headrest releasing operating component 222" pivotally engages with a corresponding one of the plurality of headrest engaging holes 52" for preventing the sliding movement of the headrest sliding assembly 202" relative to the first pivoting component 5". The headrest releasing operating component 222" pivotally disengages from a corresponding one of the plurality of headrest engaging holes 52" for allowing the sliding movement of the headrest sliding assembly 202" relative to the first pivoting component 5". In detail, the headrest shell 212" is slidably sleeved on the first pivoting component 5". A headrest accommodating chamber **212*a*" is formed in the headrest shell 212". A headrest opening is formed on the headrest shell 212" and communicated with the headrest accommodating chamber 212*a*", and the headrest releasing operating component 222" is disposed inside the headrest accommodating chamber 212*a*". In this embodiment, the headrest releasing operating component 222" includes a headrest operating portion 222*a*", which is a button structure, and a headrest engaging portion 222*b*" fixed with the headrest operating portion 222*a*". The headrest engaging portion 222*b*" is pivoted to the headrest shell 212", and the headrest engaging portion 222*b*" is driven to pivotally engage with or disengage from a corresponding one of the plurality of headrest engaging holes 52" by operation of the headrest operating portion 222*a*", which achieves a purpose of allowing or restraining the sliding movement of the headrest sliding assembly 202" relative to the first pivoting component 5"**.

Furthermore, in order to resiliently recover the headrest releasing operating component 222" to engage with a corresponding one of the plurality of headrest engaging holes 52" after releasing the headrest releasing operating component 222", the headrest sliding assembly 202" further includes a headrest resilient component 203". A middle portion of the headrest releasing operating component 222" is pivoted to the headrest shell 212", and the headrest resilient component 203" is disposed inside the headrest accommodating chamber 212*a*" and located between the first pivoting component 5" and an abutting end of the headrest releasing operating component 222" to bias an engaging end of the headrest releasing operating component 222" to engage with a corresponding one of the plurality of headrest engaging holes 52". However, the present invention is not limited to this embodiment. For example, the headrest releasing operating component can be at least partially disposed inside the headrest accommodating chamber, i.e., the headrest operating portion can be exposed out of the headrest shell for providing easy access to operate. Preferably, the headrest resilient component 203" can be a compression spring. However, it is not limited thereto. For example, the headrest resilient component can be a torsional spring, a leaf spring or any other resilient structure.

Figure 14:
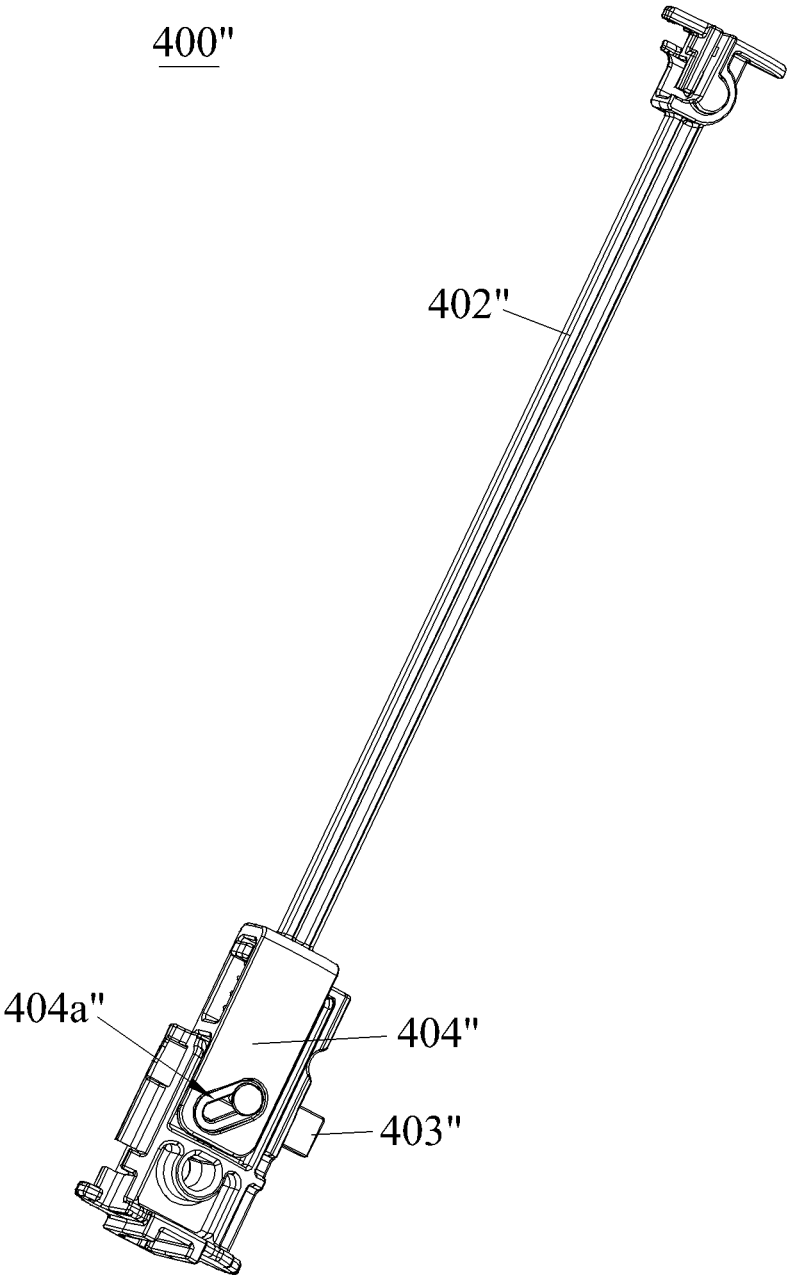
FIG. 14 is a diagram of a first length adjusting mechanism according to the third embodiment of the present invention.

Please refer to FIG. 12 to FIG. 14. FIG. 14 is a diagram of a first length adjusting mechanism according to the third embodiment of the present invention. As shown in FIG. 12 to FIG. 14, in this embodiment, in order to achieve a purpose of adjusting a length of the handle, i.e., the second pivoting component 6", the second pivoting component 6" includes a handle main body 61", a handle adjusting portion 62", and the wheelchair 100" further includes the two first length adjusting mechanisms 400". The handle adjusting portion 62" is slidably disposed inside the handle main body 61". The handle adjusting portion 62" can be adjusted relative to the handle main body 61" by operating the two first length adjusting mechanisms 400". The two first length adjusting mechanisms 400" are located on two lateral sides of the wheelchair 100". Detailed description of the first length adjusting mechanism 400" at one side is provided as follows, and the first length adjusting mechanism 400" at the other side has the same structure and operational mechanism. In this embodiment, the first length adjusting mechanism 400" includes a first sliding component 401", a first pulling component 402", a first engaging component 403" and a first driving component 404". The first pulling component 402", the first engaging component 403" and the first driving component 404" are slidably disposed inside the handle main body 61" and the handle adjusting portion 62". The first sliding component 401" is slidably disposed on an outer side of the handle adjusting portion 62". A first end of the first pulling component 402" is fixedly connected to the first sliding component 401". A second end of the first pulling component 402" is connected to the first driving component 404". An inclined slot 404*a*" is formed on the first driving component 404". The first engaging component 403" movably engages with the inclined slot 404*a*". A plurality of handle engaging holes 61*a*" is formed on the handle main body 61" at intervals for engaging with the first engaging component 403". The first sliding component 401" can be operated to slide to pull the first pulling component 402" to drive the first driving component 404" to drive the first engaging component 403" by the inclined slot 404*a*", so as to engage the first engaging component 403" with or disengage the first engaging component 403" from a corresponding one of the plurality of handle engaging holes 61*a*" for achieving a purpose of adjusting the handle adjusting portion 62" relative to handle main body 61". In this embodiment, the handle main body 61" and the handle adjusting portion 62" can be pipe structures.

Preferably, the first length adjusting mechanism 400" can further include a first resilient component, which is not shown in the figures, disposed between the first pulling component 402" and the first driving component 404". When the first sliding component 401" is operated to slide to pull the first pulling component 402" to drive the first driving component 404" to drive the first engaging component 403" by the inclined slot 404*a*", so as to disengage the first engaging component 403" from a corresponding one of the plurality of handle engaging holes 61*a*", the first resilient component is resiliently compressed. The first resilient component can drive the first driving component 404" to recover to drive the first engaging component 403" by the inclined slot 404*a*", so as to engage the first engaging component 403" with a corresponding one of the plurality of handle engaging holes 61*a*" when first pulling component 402" or the first sliding component 401" is released.

Furthermore, as shown in FIG. 11, the wheelchair 100" further includes a canopy 300". The canopy 300" is disposed on the headrest supporting component 201" or the headrest sliding assembly 202". The canopy 300" is adjustable together with the headrest supporting component 201" or the headrest sliding assembly 202" by sliding movement of the headrest sliding assembly 202" relative to the first pivoting component 5".

As shown in FIG. 11 and FIG. 14, the wheelchair 100" further includes two adjusting pipes 109" slidably disposed inside the rear frame component 102. In order to achieve a purpose of adjusting the two adjusting pipe 109" relative to the rear frame component 102", the wheelchair 100" further includes two second length adjusting mechanisms 500" disposed between the two adjusting pipes 109" and the rear frame component 102". The two second length adjusting mechanisms 500" are located at the two lateral sides of the wheelchair 100". Detailed description of the second length adjusting mechanisms 500" at one side is provided, and the second length adjusting mechanisms 500" at the other side has the same structure and operational mechanism. The second length adjusting mechanism 500" has similar structure to the first length adjusting mechanism 400" and includes a second sliding component 501", a second pulling component, a second engaging component and a second driving component. The second pulling component, the second engaging component and the second driving component are disposed inside the adjusting pipe 109 and the rear frame component 102" and not shown in the figures. The second sliding component 501" is slidably disposed on an outer side of the adjusting pipe 109". A first end of the second pulling component is fixedly connected to the second sliding component 501". A second end of the second pulling component is connected to the second driving component. A second inclined slot, which is not shown in the figures, is formed on the second driving component. The second engaging component movably engages with the second inclined slot.

A plurality of second engaging holes, which is not shown in the figures, is formed on the rear frame component 102" at intervals for engaging with the second engaging component. The second sliding component 501" can be operated to slide to pull the second pulling component to drive the second driving component to drive the second engaging component by the second inclined slot, so as to engage the second engaging component with or disengage the second engaging component from a corresponding one of the plurality of second engaging holes for achieving a purpose of adjusting the adjusting pipe 109" relative to the rear frame body 102". Preferably, the first second adjusting mechanism 500" can further include a second resilient component, which is not shown in the figures, disposed between the second pulling component and the second driving component. When the second sliding component 501" is operated to slide to pull the second pulling component to drive the second driving component to drive the second engaging component by the second inclined slot, so as to disengage the second engaging component from a corresponding one of the plurality of second engaging holes, the second resilient component is resiliently compressed accordingly. The second resilient component can drive the second driving component to recover to drive the second engaging component by the second inclined slot, so as to engage the second engaging component with a corresponding one of the plurality of second engaging holes when the second sliding component is released.

In contrast to the prior art, in the present invention, the adjustable leg rest can be adjusted between different positions relative to the chair frame for supporting the user's legs, especially the user's calves, at different angles. Furthermore, the adjustable backrest can be adjusted between different positions relative to the chair frame for supporting the user's back portion at different angles. Therefore, the present invention allows the user to sit with different gestures to reduce the pain in the user's back portion or legs. Furthermore, the present invention has advantages of easy operation and simplified structure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An adjustable backrest adapted for a chair frame whereon a user sits, the adjustable backrest comprising:

a first pivoting component;

a second pivoting component pivoted to the first pivoting component;

at least one backrest sliding assembly slidably disposed on the first pivoting component; and at least one backrest connecting component disposed between the first pivoting component and the second pivoting component, a first end of the at least one backrest connecting component being pivoted to the at least one backrest sliding assembly, a second end of the at least one backrest connecting component being pivoted to the second pivoting component, and the at least one backrest sliding assembly driving the second pivoting component to pivot relative to the first pivoting component by the at least one backrest connecting component when the at least one backrest sliding assembly slides relative to the first pivoting component;

wherein one of the first pivoting component and the second pivoting component is pivoted to the chair frame, and another of the first pivoting component and the second pivoting component supports the user's back portion.

2. The adjustable backrest of claim 1, wherein the at least one backrest sliding assembly comprises:

a backrest shell slidably disposed on the first pivoting component; and a backrest releasing operating component pivoted to the backrest shell, a plurality of backrest engaging holes being formed on the first pivoting component, the backrest releasing operating component pivotally engaging with a corresponding one of the plurality of backrest engaging holes for preventing sliding movement of the at least one backrest sliding assembly relative to the first pivoting component, the backrest releasing operating component pivotally disengaging from the corresponding one of the plurality of backrest engaging holes for allowing the sliding movement of the at least one backrest sliding assembly relative to the first pivoting component.

3. The adjustable backrest of claim 2, wherein the backrest shell is slidably sleeved on the first pivoting component, a backrest accommodating chamber is formed in the backrest shell, a backrest opening is formed on the backrest shell and communicated with the backrest accommodating chamber, and the backrest releasing operating component is at least partially disposed inside the backrest accommodating chamber.

4. The adjustable backrest of claim 3, wherein the at least one backrest sliding assembly further comprises a backrest resilient component, a middle portion of the backrest releasing operating component is pivoted to the backrest shell, and the at least one backrest resilient component is disposed inside the backrest accommodating chamber and located between the first pivoting component and an abutting end of the backrest releasing operating component to bias an engaging end of the backrest releasing operating component to engage with the corresponding one of the plurality of backrest engaging holes.

5. The adjustable backrest of claim 2, wherein the backrest releasing operating component comprises a backrest operating portion and a backrest engaging portion fixed with the backrest operating portion, the backrest engaging portion is pivoted to the backrest shell, and the backrest engaging portion is driven to pivotally engage with or disengage from the corresponding one of the plurality of backrest engaging holes by operation of the backrest operating portion.

6. The adjustable backrest of claim 5, wherein a protrusion protrudes from the backrest engaging portion for engaging with the corresponding one of the plurality of backrest engaging holes.

7. The adjustable backrest of claim 2, further comprising an operating rod fixedly connected to the backrest releasing operating component for driving the backrest releasing operating component to pivot relative to the backrest shell.

8. The adjustable backrest of claim 7, further comprising an auxiliary rod disposed on the first pivoting component and for cooperating with the operating rod for driving the backrest releasing operating component to pivot relative to the backrest shell.

9. A wheelchair comprising:

a chair frame whereon a user sits; and an adjustable backrest comprising:

a first pivoting component;

a second pivoting component pivoted to the first pivoting component;

at least one backrest sliding assembly slidably disposed on the first pivoting component; and at least one backrest connecting component disposed between the first pivoting component and the second pivoting component, a first end of the at least one backrest connecting component being pivoted to the at least one backrest sliding assembly, a second end of the at least one backrest connecting component being pivoted to the second pivoting component, and the at least one backrest sliding assembly driving the second pivoting component to pivot relative to the first pivoting component by the at least one backrest connecting component when the at least one backrest sliding assembly slides relative to the first pivoting component;

wherein one of the first pivoting component and the second pivoting component is pivoted to the chair frame, and another of the first pivoting component and the second pivoting component supports the user's back portion.

10. The wheelchair of claim 9, further comprising an adjustable headrest, and the adjustable headrest comprising:

a headrest supporting component; and at least one headrest sliding assembly slidably disposed on the adjustable backrest, the headrest supporting component being installed on the at least one headrest sliding assembly, a height of the headrest supporting component being adjustable by sliding movement of the at least one headrest sliding assembly relative to the adjustable backrest.

11. The wheelchair of claim 10, wherein the at least one headrest sliding assembly comprises:

a headrest shell slidably disposed on the adjustable backrest; and a headrest releasing operating component pivoted to the headrest shell, a plurality of headrest engaging holes being formed on the adjustable backrest, the headrest releasing operating component pivotally engaging with a corresponding one of the plurality of headrest engaging holes for preventing the sliding movement of the at least one headrest sliding assembly relative to the adjustable backrest, the headrest releasing operating component pivotally disengaging from the corresponding one of the plurality of headrest engaging holes for allowing the sliding movement of the at least one headrest sliding assembly relative to the adjustable backrest.

12. The wheelchair of claim 11, wherein the headrest shell is slidably sleeved on the adjustable backrest, a headrest accommodating chamber is formed in the headrest shell, a headrest opening is formed on the headrest shell and communicated with the headrest accommodating chamber, and the headrest releasing operating component is at least partially disposed inside the headrest accommodating chamber.

13. The wheelchair of claim 12, wherein the at least one headrest sliding assembly further comprises a headrest resilient component, a middle portion of the headrest releasing operating component is pivoted to the headrest shell, and the headrest resilient component is disposed inside the headrest accommodating chamber and located between the adjustable backrest and an abutting end of the headrest releasing operating component to bias an engaging end of the headrest releasing operating component to engage with the corresponding one of the plurality of headrest engaging holes.

14. The wheelchair of claim 11, wherein the headrest releasing operating component comprises a headrest operating portion and a headrest engaging portion fixed with the headrest operating portion, the headrest engaging portion is pivoted to the headrest shell, and the headrest engaging portion is driven to pivotally engage with or disengage from the corresponding one of the plurality of headrest engaging holes by operation of the headrest operating portion.

15. The wheelchair of claim 10, further comprising a canopy disposed on one of the headrest supporting component and the at least one headrest sliding assembly.

16. The wheelchair of claim 9, wherein the chair frame comprises a front frame component and a rear frame component pivoted to the front frame component, and the one of the first pivoting component and the second pivoting component is pivoted to the rear frame component.

17. The wheelchair of claim 16, wherein the chair frame further comprises at least one handrail disposed between the rear frame component and the one of the first pivoting component and the second pivoting component, a first end of the at least one handrail is pivoted to the rear frame component, a second end of the at least one handrail is pivoted to the one of the first pivoting component and the second pivoting component, and the one of the first pivoting component and the second pivoting component drives the rear frame component to pivot relative to the front frame component by the at least one handrail when the one of the first pivoting component and the second pivoting component pivots relative to the rear frame component.

18. The wheelchair of claim 17, wherein the chair frame further comprises at least one handrail connecting component disposed between the rear frame component and the one of the first pivoting component and the second pivoting component, a first end of the at least one handrail connecting component is pivoted to the rear frame component, a second end of the at least one handrail connecting component is pivoted to the one of the first pivoting component and the second pivoting component, and the one of the first pivoting component and the second pivoting component drives the rear frame component to pivot relative to the front frame component by the at least one handrail connecting component when the one of the first pivoting component and the second pivoting component pivots relative to the rear frame component.

19. The wheelchair of claim 16, wherein the chair frame further comprises a frame restraining component pivoted to the one of the first pivoting component and the second pivoting component for engaging with the rear frame component for restraining pivoting movement of the one of the first pivoting component and the second pivoting component relative to the rear frame component.

20. The wheelchair of claim 16, wherein the chair frame further comprises a lower frame component disposed between the front frame component and the rear frame component.

* * * * *